US006533632B1

(12) United States Patent
Dynka

(10) Patent No.: US 6,533,632 B1
(45) Date of Patent: Mar. 18, 2003

(54) METHOD OF EVACUATING AND SEALING FLAT PANEL DISPLAYS AND FLAT PANEL DISPLAYS USING SAME

(75) Inventor: Danny Dynka, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/251,977

(22) Filed: Feb. 18, 1999

(51) Int. Cl.[7] ..... H01J 9/26
(52) U.S. Cl. ..... 445/25; 445/23
(58) Field of Search ..... 445/25, 43

(56) References Cited

U.S. PATENT DOCUMENTS 2,882,116 A * 4/1959 Williams ..... 445/43
5,541,473 A * 7/1996 Duboc et al. ..... 313/309
5,688,708 A * 11/1997 Kato et al. ..... 445/25
5,697,825 A 12/1997 Dynka et al. ..... 445/25
5,827,102 A * 10/1998 Watkins et al. ..... 445/25
6,129,603 A * 10/2000 Sun et al. ..... 445/25

* cited by examiner

*Primary Examiner*—Kenneth J. Ramsey
(74) *Attorney, Agent, or Firm*—Dorsey & Whitney, LLP

(57) ABSTRACT

A method of evacuating and sealing the space between the baseplate and the faceplate of a field emission display. A frit bead is formed around the perimeter of the baseplate, and is then heated to a temperature at which a plurality of surface irregularities are formed on the surface of the bead. After the faceplate is placed on top of the frit bead, the panels are placed in a vacuum, and the space between the plates is evacuated through gaps in the frit bead formed by the surface irregularities. After the space between the plates has been evacuated, the frit bead is heated to a temperature that is high enough to allow the frit to at least partially flow. A compressive force applied between the plates compresses the frit bead, thereby bonding the frit bead to the plates. The plates are then allowed to cool before removing the plates from the vacuum.

45 Claims, 5 Drawing Sheets

METHOD OF EVACUATING AND SEALING FLAT PANEL DISPLAYS AND FLAT PANEL DISPLAYS USING SAME

STATEMENT AS TO GOVERNMENT RIGHTS

This invention was made with government support under Contract No. DABT-63-93-C-0025 by Advanced Research Projects Agency (ARPA). The government has certain rights to this invention.

TECHNICAL FIELD

This invention relates to flat panel displays having a baseplate used to generate an image and a faceplate through which the image is adapted to be viewed, and, more particularly, to a method of evacuating and sealing the space between the faceplate and baseplate, as well as flat panel displays and components fabricated using such method.

BACKGROUND OF THE INVENTION

Flat panel displays are commonly used for a variety of purposes, such as for notebook computer displays, display panels for electronic instruments and devices, and portable televisions and camcorders, to name a few. One commonly used flat panel display is a liquid crystal display in which an image is generated by applying signals to a baseplate to selectively modulate the transmissivity of a liquid crystal filling the space between the baseplate and a transparent faceplate. The transmissivity of the liquid crystal is modulated on a pixel-by-pixel basis to generate a monochromatic or color image that is visible through the faceplate.

Another type of flat panel display that has been proposed for use in a wide variety of applications are field emission displays. Field emissions displays employ a baseplate having a substrate containing an array of emitters or emitter sets (a group of emitters connected to each other) and an extraction grid surrounding each of the emitters. The emitters are generally biased between −30 and 0 volts, while the extraction grids are generally biased between 30 and 100 volts. When the voltage of an extraction grid is more positive by a sufficient voltage (e.g., 60 volts or more), electrons are extracted from the emitter.

The field emission display also includes a faceplate that is spaced apart from and parallel to the baseplate, thereby forming a space between the baseplate and faceplate. The surface of the faceplate facing the baseplate is coated with a layer of transparent conductive material, such as indium tin oxide ("ITO"). Finally, the transparent conductive layer is coated with a layer of a cathodoluminescent material. The cathodoluminescent material may be applied to the transparent conductive layer either uniformly or in a pattern corresponding to a desired image. Different cathodoluminescent materials also may be applied in different locations to create color images or images of multiple colors.

In operation, a large positive voltage, on the order of 1000 volts, is applied to the conductive layer coating the faceplate to draw the electrons emitted by the emitters to the conductive material. The electrons traveling to the faceplate strike the cathodoluminescent material, thereby giving up their energy thus causing the cathodoluminescent material to be illuminated and portray an image which may be viewed through the transparent faceplate. The space between the baseplate and the faceplate of field emission displays must be evacuated and remain evacuated after prolonged periods of use. Should the space between the baseplate and faceplate not be adequately evacuated, residual gases in the space, when energized by the extracted electrons, can start arcing or even glow discharge thereby seriously limiting the operating and useful life of field emission displays. The emitters must also be precisely aligned to predetermined areas of the cathodoluminescent material. A gettering agent, such as ST-122 gettering agent sold by SAES, is placed in the space between the baseplate and the faceplate to maintain the vacuum environment at times of use and storage.

As illustrated in FIGS. 1 and 2, a faceplate 10 is generally glass or glass/ceramic, and generally a sealing material frit, such as glass or metal, forms a bead 12 extending around the perimeter of the faceplate 10 near its periphery 14. To assemble a field emission display, a field emission display baseplate 20 (FIG. 2) is placed over the faceplate 10 against an interface surface 24 formed along the upper surface of the frit bead 12. The plates 10, 20 are heated above a temperature at which the frit bead 12 will flow, either under the weight of one of the plates or with the application of a compressive force upon the plates 10, 20. The frit bead 12 is thus compressed, thereby causing the frit bead 12 to flow or extrude and adhere to the plates 10, 20. After the plates 10, 20 cool, the frit bead 12 forms a seal between the plates 10, 20.

The above-described procedure would be entirely satisfactory if it was not necessary for the space between the plates 10, 20 to be evacuated. However, as mentioned previously, the space between the plates 10, 20 must be substantially evacuated. There are two primary approaches to evacuating the space between the plates 10, 20. In one of these approaches, a tube or other conduit (not shown) is embedded in the frit bead 12. A hole could also be formed in one of the plates, such as by drilling. An evacuation tube would then be fritted to the plate overlying the hole during thermal processing of the plates 10, 20, to form a rigid, airtight seal between the plates 10, 12. The space between the plates 10, 20 is evacuated by means of vacuum pumping through the tube or conduit, and the tube or conduit is thermally or resistively heated to collapse and seal itself. This approach has several disadvantages, including the expense of creating and then sealing the tube or conduit, and the potential for subsequent leakage or possible breakage. Also, this approach requires space for the tube or conduit, which may be difficult in some applications, such as in laptops, where packaging space is limited.

Another conventional approach to evacuating and sealing the space between the plates 10, 20 is illustrated in FIG. 3 and described in U.S. Pat. Nos. 5,697,825 and 5,788,551 to Dynka et al., which are incorporated herein by reference. In this approach, frit protrusions 28 are formed at spaced apart locations along the frit bead 12, such as at the comers of the face plate 10. When the baseplate 20 is placed on the faceplate 10, the protrusions 28 position the baseplate 20 above the interface surface 24 of the frit bead 12. As a result, gaps 30 are formed between the baseplate 20 and the interface surface 24 of the frit bead 12 and provide a flow path for evacuating the space defined by the plates 10, 20 and the frit bead 12.

After the baseplate 20 is placed on the protrusions 28, the plates 10, 20 are placed in an evacuation oven (not shown). The evacuation oven heats the plates 10, 20 in an environment of substantially zero pressure. As the pressure in the evacuation oven is reduced, residual gases, comprised mainly of air, are drawn through the gaps 30 from the space between the plates 10, 20. After the space between the plates 10, 20 has been substantially evacuated, the plates 10, 20 are heated to a temperature at which the frit bead 12 will flow. A compressive force applied to the plates 10, 20 causes the protrusions 28 to totally collapse into the frit bead 12 and the frit bead 12 to partially compress. The frit bead 12 then bonds to the faceplate 20 so that a hermetic seal is formed between the plates 10, 20. The plates are allowed to cool before removing the vacuum from the evacuation oven and exposing the plates 10, 20 to atmospheric pressure. The result of this procedure is a hermetically sealed, evacuated space between the plates 10, 20.

Although the above-described procedure has several advantages over the use of a tube or conduit to evacuate a space, it nevertheless can be improved. First, the need to form protrusions 28 on the frit bead 12 adds to the time and expense of manufacturing field emission displays. Second, it is difficult to ensure that all of the protrusions 28 are of exactly the same size. Yet it is possible for sized protrusions 28 to allow the frit bead 12 to compress unevenly. Although spacers (not shown) are generally used to space the faceplate 10 a fixed distance from the baseplate 20, it is nevertheless undesirable for the frit bead 12 to compress unevenly. As a result of these and other problems, the use of protrusions 28 may be less than ideal for the tight tolerances between the baseplate 10 and the faceplate 20.

Another approach is described in U.S. Pat. No. 5,827,102 entitled "Low Temperature Method For Evacuating And Sealing Field Emission Displays," incorporated herein by reference. In this approach, a low melting temperature material such as indium, is applied as a seal material. A flow path for evacuation is provided by non-conformance of the seal material with opposing surfaces.

SUMMARY OF THE INVENTION

The inventions defined by the respective claims are directed to methods for evacuating and sealing a flat panel display of the type having first and second planar plates. A frit bead of substantially uniform thickness is initially formed along the periphery of one of the plates so that an interface surface facing away from the plate is substantially flat. The plate and frit are then heated to a temperature that pre-glazes the frit bead. As a result, a plurality of surface irregularities are formed on the interface surface of the frit bead. The other plate is then placed on the interface surface of the frit bead so that a space is at least partially defined by the platen and the frit bead. The environment surrounding the plates is then evacuated. However, prior to placing the plates together, a getter may be placed between the plates. The surface irregularities on the interface surface of the frit bead provide flow paths between the frit bead and the other plate which allow gasses to flow from the space between the plates. As a result, the space between the plates equalize to the vacuum surrounding the plates. After the space between the plates has been evacuated, the plates and frit bead are heated to a temperature above the temperature at which the frit bead at least partially flows. A force is then applied to the first and second plates to move the platen toward each other. The applied force, along with the elevated temperature, causes at least partial compression of the frit bead. Finally, the plates are allowed to cool below the temperature at which the frit bead at least partially flows. This results in a vacuum in the space between the plates and a hermetic seal being formed by the frit bead. The vacuum is then maintained by the getter, which is activated during formation of the seal. Furthermore, this result has been accomplished without the addition to the field emission display of any structural component.

The frit bead preferably comprises either glass or metal particles mixed with a binder, although other compositions may be used. The plate on which the frit bead is formed is preferably heated to a temperature in the range of 250–350 degrees centigrade for a period of approximately 1 hour to pre-glaze the frit to form the surface irregularities. Pre-glazing the frit also reduces the binding agents, such as organic solvents and water. In contrast, the plates are preferably heated to a temperature in the range of 350–500 degrees centigrade for a period of approximately 1 hour to heat the plates to a temperature above the temperature at which the frit bead at least partially flows. The plates are preferably allowed to cool in two stages. In the first stage, the plates are preferably allowed to cool to a temperature in the range of 350–425 degrees centigrade, and they remain in that range for a period of time of approximately 1–2 hours to further activate nonevaporative getter material. In the second stage, the plates are preferably allowed to cool to ambient temperature over a period of at least 3 hours. The step of applying a compressive force upon the plates may be accomplished by a variety of techniques, such as by stacking the plates and placing a weight on them, or by applying a compressive clamping force upon the plates. Prior to joining and sealing the two panels to each other, a plurality of spacers may be placed between the plates. The spacers should have a spacing height that is less than the distance between the height of the frit bead so that the frit bead compresses to the level of the spacers.

DETAILED DESCRIPTION OF THE INVENTION

Figure 1:
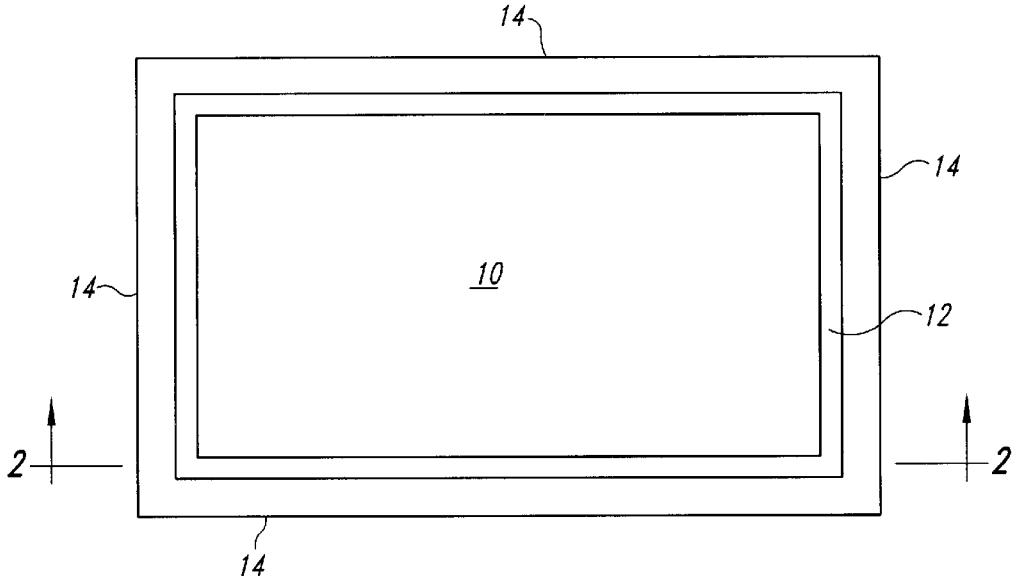
Fig. 1 (Prior Art)
FIG. 1 is a top plan view of a field emission display faceplate on which a frit bead has been formed in accordance with prior art fabrication techniques.
Figure 2:
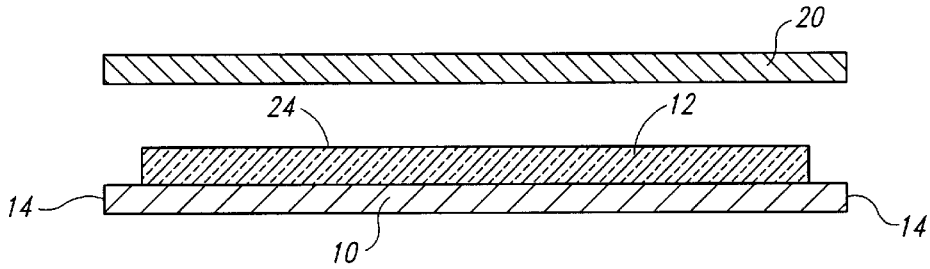
Fig. 2 (Prior Art)
FIG. 2 is a cross-sectional view taken along the line 2—2 of FIG. 1.
Figure 3:
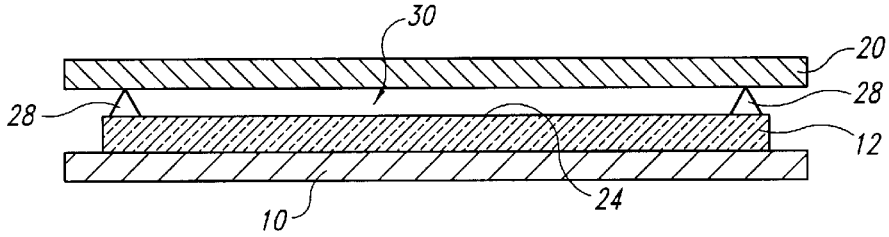
Fig. 3 (Prior Art)
FIG. 3 is a cross-sectional view showing a conventional technique for spacing field emission display baseplates and faceplates from each to allow evacuation of the space between the plates according to a prior art fabricating technique.
Figure 4:
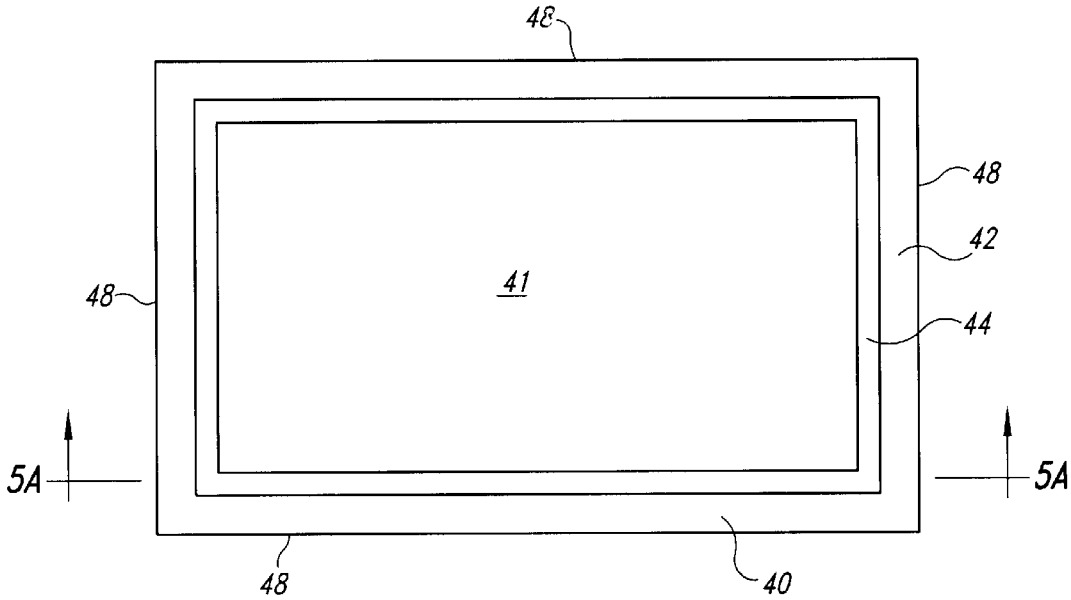
FIG. 4 is a top plan view of a first step in the preferred embodiment of the inventive method for evacuating and sealing a flat panel display in which a frit bead is formed on one of the plates of the display.
Figure 5A:
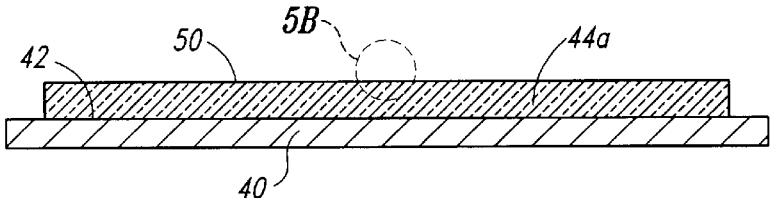
FIG. 5A is a cross-sectional view taken along the line 5A—5A of FIG. 4.

The first step in the preferred embodiment of the invention is illustrated in FIGS. 4 and 5A and B. A field emission display faceplate 40 of generally rectangular configuration has an inner surface 42 on which a bead 44 of a suitable frit, such as glass or metal frit, is formed along its perimeter near its periphery. The bead 44 thus created a partially enclosed space 41 surrounded by the bead 44. This first step of the preferred embodiment shown in FIGS. 4, 5A and 5B is identical to the first step of the prior art process illustrated in FIGS. 1 and 2.

Figure 5B:
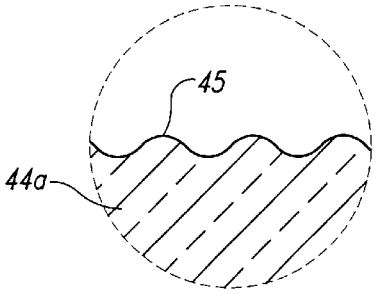
FIG. 5B is a detailed cross-sectional view of the indicated portion of FIG. 5A.

Next, the faceplate 40 is heated to a temperature that pre-glazes the frit bead 44, thus forming a pre-glazed bead 44A (FIGS. 5A and 5B). In one embodiment of the invention, the faceplate 40 and frit bead 44 are heated to a temperature of between 125 and 250 degrees for a period of about 1 hour. The temperature is, once again, raised to a temperature of 250–350 degrees centigrade somewhat gradually, such as over a period of 1 hour. Significantly, heating the frit bead 44 to this temperature causes minute irregularities 45 to be formed on an interface surface 50 of the pre-glazed frit bead 44A, as best illustrated in FIG. 5B. It has not been heretofore recognized that these irregularities can be formed, nor, of course, has it been heretofore recognized that these irregularities could be employed for any useful purpose.

Figure 6A:
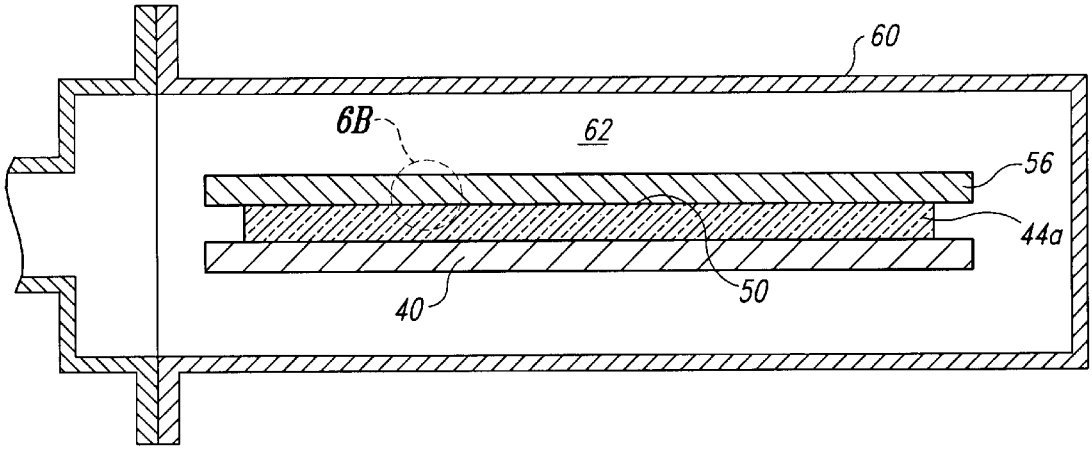
FIG. 6A is a schematic sectional view showing an evacuating and heating step in the preferred embodiment of the inventive method for evacuating and sealing a flat panel display.
Figure 6B:
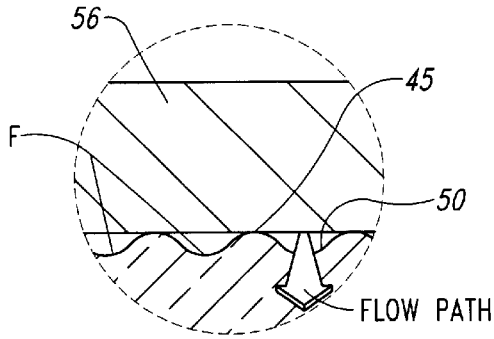
FIG. 6B is a detailed cross-sectional view of the indicated portion of FIG. 6A.
Figure 7:
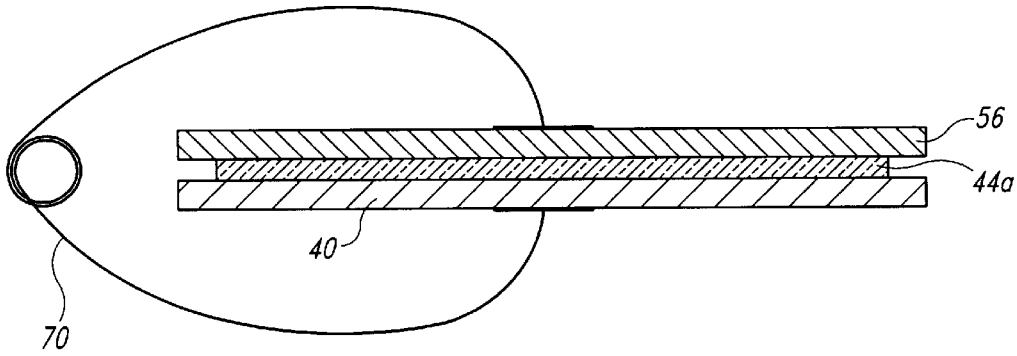
FIG. 7 is a schematic sectional view showing a clamping technique for applying a compressive force between the plates in the step illustrated in FIG. 6.
Figure 8:
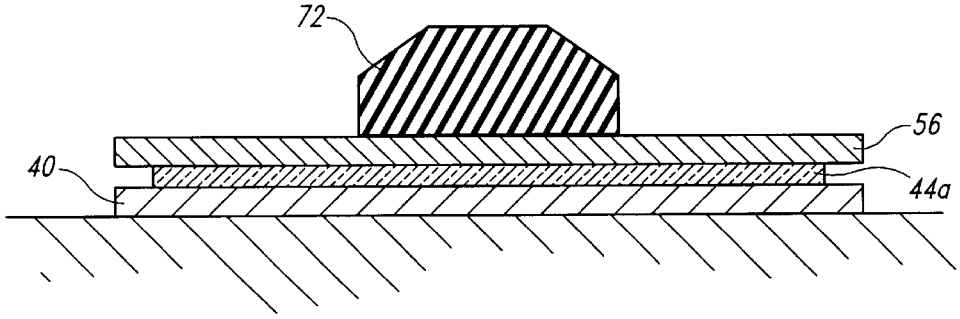
FIG. 8 is a schematic sectional view showing the use of a weight for applying a compressive force between the plates in the step illustrated in FIG. 6.

After the faceplate 40 has been heated to form the surface irregularities on the pre-glazed frit bead 44A, a field emission display baseplate 56 is placed on the interface surface 50 of the frit bead 44A, as illustrated in FIGS. 6A and 6B. As best illustrated in FIG. 6B, flow paths F are formed by gaps between the baseplate 56 and the irregularities 45 on the interface surface 50. The plates 40, 56 are then placed in a chamber 62 of a conventional evacuation oven 60, as also illustrated in FIG. 6. As is conventional with such ovens 60, the chamber 62 may be both heated and evacuated. The chamber 62 is first evacuated to a suitable vacuum, such as about $10^{-7}$ torr over a period of 2 hours. The vacuum in the chamber 62 evacuates the space 41 (FIG. 4) between the faceplate 40 and the baseplate 56 through the flow paths F (FIG. 6B). After the chamber 62 has reached the target vacuum, the chamber 62 is heated to a sufficient temperature that the pre-glazed frit bead 44A is able to at least partially flow. This heat also activates any gettering agent, such as SAES non-evaporative getter agent (not shown), that is placed in the space between the faceplate 40 and the baseplate 56. In one embodiment, the chamber 62 is heated to a temperature in the range of 350 to 500 degrees centigrade, and remains there for a period of about 1 hour. During this time a compressive force is applied upon the faceplate 40 and the baseplate 56 by suitable means to compress the pre-glazed frit bead 44A so that the flow paths F are closed and the bead 44A will adhere to both the faceplate 40 and the baseplate 56. The compressive force may be applied with a conventional clamp 70 as shown in FIG. 7, by placing a weight 72 on one of the plates 40, 56 as shown in FIG. 8, or by other means. If a weight is used as shown in FIG. 8, the magnitude of the weight 72 is preferably chosen so that the weight 72 compresses the pre-glazed frit bead 44A to a predetermined height. Similarly, if the clamp 70 is used, the magnitude of the compressive force of the clamp 70 is preferably chosen so that the clamp 70 compresses the pre-glazed frit bead 44A to a predetermined height.

Figure 9:
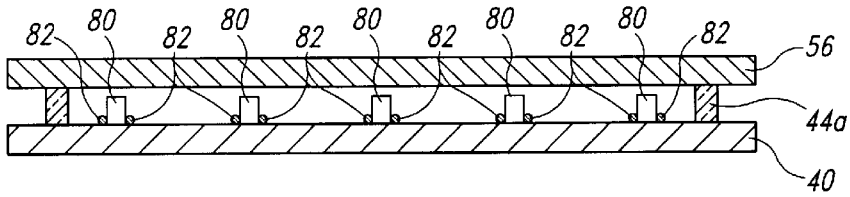
FIG. 9 is a side elevational view showing the use of spacers and a gettering material positioned between the plates prior to the compression of a frit bead.

Although the compressive force can be controlled to compress the pre-glazed frit bead 44A to a specific level, the final compressed height of the frit bead 44A (and hence the spacing between the faceplate 40 and baseplate 56) is preferably controlled by placing a plurality of spacers 80 on the faceplate 40 before it is covered by the baseplate 56 (FIG. 9). The spacers 80 are shown in FIG. 9 after they have been covered by the baseplate 56 and before the pre-glazed frit bead 44A has been compressed. The height of the spacers 80 should be less than the uncompressed height of the pre-glazed frit bead 44A so that the bead 44A will be able to compress sufficiently. Conventionally gettering material preferably in the form of a getter foil 82 may also be placed on the faceplate 40 before it is covered by the baseplate 56. The getter foil 82 is shown adjacent the spacers 80, but it may be placed at other locations between the plates 40, 56.

After the plates 40, 56 have been heated as shown in FIG. 6, they are allowed to cool to an intermediate temperature, preferably gradually over a period of about 1 hour. In the preferred embodiment of the invention, the intermediate temperature is in the range of 350–425, and it preferably remains at that temperature for about 1–2 hours. During this time, the compressed frit bead 44A gradually crystallizes and hardens as well as more firmly adheres to the faceplate 40 and the baseplate 56. Also, ST-122 gettering material 82 that has been added to the space between the plates 40, 56 is further activated during this time.

Finally, the plates 40, 56 are allowed to cool to ambient temperature. This cooling is preferably done very gradually, such as over a period of at least 3 hours. At the end of this cooling period, the pressure surrounding the plates 40, 56 can be increased to atmospheric pressure. The pressure surrounding the plates 40, 56 can alternatively be increased to atmospheric pressure before the end of this cooling period as long as the pre-glazed frit bead 44A has cooled sufficiently to withstand the pressure.

Figure 10:
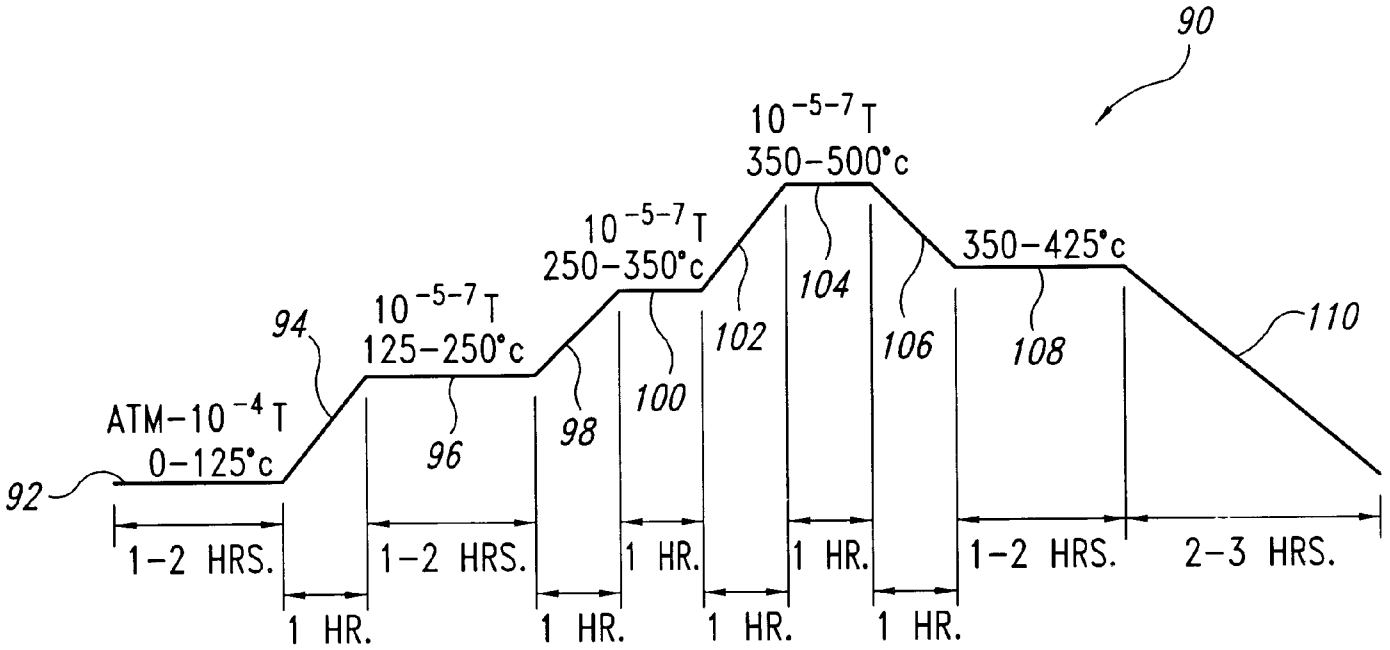
FIG. 10 is a graph showing the timed sequence of heating steps used to fabricate field emission displays according to the preferred embodiment of the inventive method.

The timing of the various stages of the preferred embodiment of the invention are summarized in the graph 90 shown in FIG. 10. During the period 92, the temperature of the faceplate 40 and baseplate 56 stabilizes at some value in the range 0–125 degrees centigrade for a period of about 1–2 hours. The faceplate 40 and baseplate 56 are preferably at a pressure of between atmospheric pressure ("ATM") and $10^{-4}$ torr. During this period 92, the temperature in the plates 40, 56 becomes uniform throughout the plates 40, 56.

During the period 94, the faceplate 40, the frit bead 44 that has been formed on the faceplate 40, and the baseplate 56 are heated to a temperature in the range of 125–250 degrees centigrade for a period 96 of about 1–2 hours at a pressure of between $10^{-5}$ torr and $10^{-7}$ torr. It is during this period 96 that any residual water is evaporated from the plates 40, 56 and organics are removed from the components, as explained above.

Next, the plate 40 and the frit bead 44 are heated during a period 98 to a temperature 250–350 degrees centigrade. This heating period 98 preferably has a duration of about 1 hour. The temperature preferably remains at 250–350 degrees centigrade at a pressure of between $10^{-5}$ torr and $10^{-7}$ torr for a period 100 of about 1–2 hours. It is during this period that the getter material is activated. It is also toward the end of this period that the space between the plates 40, 56 is evacuated through the surface irregularities on the interface surface 50 of the frit bead 44.

The plates 40, 56 and pre-glazed frit bead 44A are heated during a period 102 of about 1 hour to a temperature in the range 350–500 degrees centigrade. The plates 40, 56 remain at that temperature at a pressure of between $10^{-5}$ torr and 10–7 torr for a period 104 of about 1 hour. It is during this period 104 that the pre-glazed frit bead 44A flows and is compressed, as explained above.

The cooling process explained above preferably occurs in two stages. During a first stage, the plates 40, 56 are allowed to cool over a period 106 of about 1 hour to an intermediate temperature in the range of 350–425 degrees centigrade. The temperature remains at that value for a period 108 of about 1–2 hours. Finally, during the second stage, the plates are allowed to cool to ambient temperature during a period 110 of 2–3 hours in duration.

It will be understood that the above temperatures and process times are illustrative purpose only since other temperatures and process times may be used as desired under specific circumstances without departing from the scope and spirit of the invention. Other modifications of the preferred embodiment may also be used. For example, the frit bead 44 may be initially applied to the faceplate 56 rather than the baseplate 40. Also, as mentioned above, the method may be used to fabricate flat panel displays other than field emission displays. Thus, while the detailed description above has been expressed in terms of a specific example, those skilled in the art will appreciate that many other structures or techniques could be used to accomplish the purpose of the disclosed procedure. Accordingly, it can be appreciated that various modifications of the above-described embodiment may be made without departing from the spirit and scope of the invention as defined by the following claims.

What is claimed is:

1. A method for evacuating and sealing a display comprising:

providing a first plate and a second plate;

disposing a frit bead around the perimeter of an inner surface of the first plate, near to the periphery of the first plate, forming an inner area surrounded by the frit bead;

heating the frit to form a plurality of surface irregularities on an interface surface of the frit;

placing a plurality of spacers within the inner area including first spacers proximate the frit bead and second spacers positioned inwardly from the first spacers and distributed throughout the inner area, the spacers having a spacing height that is less than a distance between the inner surface of the first plate and the interface surface of the frit bead;

placing the second plate on the frit to at least partially define a space;

allowing the first and second plates to stabilize at a temperature between 0–125 degrees centigrade for a period of 1–2 hours and the heating the first and second plates to a temperature in the range of 125–250 degrees centigrade for a period of 1–2 hours;

evacuating the space using a flow path provided by the surface irregularities;

heating the plates to a temperature above the temperature at which the frit at least partially flows while applying a force to the first and second plates to at least partially compress the frit; and allowing the first and second plates to cool over a period of about 1 hour to an intermediate temperature in the range of 350–425 degrees centigrade, maintaining the intermediate temperature for a period of 1–2 hours, then allowing the first and second plates to cool to an ambient temperature over a 2–3 hour period.

2. The method of claim 1 wherein the frit comprises glass particles mixed with a binder.

3. The method of claim 1 wherein the step of heating and applying a force to the first and second plates comprises placing a weight on one of the plates.

4. The method of claim 3 wherein the step of placing a weight on one of the plates comprises placing a weight on the plate having a magnitude causing the frit to compress to a predetermined level.

5. The method of claim 1 wherein the step of applying a force to the first and second plates toward each other comprises applying a compressive clamping force to the first and second plates in a direction normal to the surface of the plates.

6. The method of claim 5 wherein the step of applying a compressive clamping force to the first and second plates comprises applying a compressive clamping force to the first and second plates having a magnitude causing the frit to compress to a predetermined level.

7. The method of claim 1 wherein the flat panel display comprises a field emission display, wherein the first planar plate comprises a field emission display faceplate, and wherein the second planar plate comprises a field emission display baseplate.

8. The method of claim 1 wherein the step of heating the first plate to a temperature that forms a plurality of surface irregularities comprises heating the first plate to a temperature in the range of 250–350 degrees centigrade.

9. The method of claim 8 wherein the step of heating the first plate to a temperature in the range of 250–350 degrees centigrade comprises heating the first plate to a temperature in the range of 250–350 degrees centigrade for a period of approximately 1 hour.

10. The method of claim 8 wherein the step of heating the first plate to a temperature in the range of 250–350 degrees centigrade comprises heating the first plate to a temperature in the range of 250–350 degrees centigrade at a pressure of between $10^{-5}$ torr and $10^{-7}$ torr.

11. The method of claim 1 wherein the step of heating the plates to a temperature above the temperature at which the frit at least partially flows comprises heating the plates to a temperature in the range of 350–500 degrees centigrade.

12. The method of claim 11 wherein the step of heating the plates to a temperature in the range of 350–500 degrees centigrade comprises heating the plates to a temperature in the range of 350–500 degrees centigrade for a period of approximately 1 hour.

13. The method of claim 11 wherein the step of heating the plates to a temperature in the range of 350–500 degrees centigrade comprises heating the plates to a temperature in the range of 350–500 degrees centigrade at a pressure of between $10^{-7}$ torr and $10^{-5}$ torr.

14. The method of claim 1 wherein the step of evacuating the environment surrounding the plates comprises reducing the pressure in the environment surrounding the plates to $10^{-7}$ torr.

15. The method of claim 1 wherein the step of evacuating the environment surrounding the plates comprises reducing the pressure in the environment surrounding the plates over a period of approximately 2 hours, thereby limiting the differential pressure across the plates to a relatively low value.

16. The method of claim 1, further including the step of placing a getter between the first and second plates before the step of placing the second plate on the interface surface of the frit.

17. The method of claim 1 wherein the second spacers are uniformly distributed throughout the cavity.

18. A method for evacuating and sealing a flat panel display of the type having first and second planar plates in which an image is adapted to be viewed through one of the plates, the method comprising:

forming an inner area on the first plate by applying a bead of frit of substantially uniform thickness along the periphery of the first plate so that an interface surface facing away from the first plate is substantially flat;

heating the first plate to a temperature in the range of 250–350 degrees centigrade for a period of approximately 1 hour, thereby forming a plurality of surface irregularities on the interface surface of the frit;

placing a plurality of spacers within the inner area including first spacers proximate the bead of frit and second spacers positioned inwardly from the first spacers and distributed throughout the inner area, the spacers having a spacing height that is less than a distance between an inner surface of the first plate and the interface surface of the frit bead;

placing the second plate on the interface surface of the frit;

allowing the first and second plates to stabilize at a temperature between 0–125 degrees centigrade for a period of 1–2 hours and the heating the first and second plates to a temperature in the range of 125–250 degrees centigrade for a period of 1–2 hours;

evacuating the environment surrounding the plates, thereby evacuating the space between the plates through gaps formed by the surface irregularities on the interface surface of the frit;

heating the plates to a temperature in the range of 350–500 degrees centigrade for a period of approximately 1 hour while applying a force to the first and second plates toward each other during at least part of the 1 hour period to at least partially compress the frit; and allowing the first plate to cool over a period of about 1 hour to an intermediate temperature in the range of 350–425 degrees centigrade, maintaining the intermediate temperature for a period of 1–2 hours, then allowing the first and second plates to cool to an ambient temperature over a 2–3 hour period.

19. The method of claim 18 wherein the frit comprises glass particles mixed with a binder.

20. The method of claim 18 wherein the step of applying a force between the first and second plates toward each other comprises placing a weight on at least one of the plates.

21. The method of claim 20 wherein the step of placing a weight on at least one of the plates comprises placing a weight on the plate having a magnitude causing the frit to compress to a predetermined level.

22. The method of claim 18 wherein the step of applying a force to the first and second plates toward each other comprises applying a compressive clamping force to the first and second plates in a direction normal to the surface of the plates.

23. The method of claim 22 wherein the step of applying a compressive clamping force to the first and second plates comprises applying a compressive clamping force to the first and second plates having a magnitude causing the frit to compress to a predetermined level.

24. The method of claim 18 wherein the flat panel display is a field emission display, wherein the first planar plate comprises a field emission display faceplate and wherein the second planar plate comprises a field emission display baseplate.

25. The method of claim 18 wherein the step of evacuating the environment surrounding the plates comprises reducing the pressure in the environment surrounding the plates to $10^{-7}$ torr.

26. The method of claim 18 wherein the step of evacuating the environment surrounding the plates comprises reducing the pressure in the environment surrounding the plates over a period of approximately 2 hours, thereby limiting the differential pressure across the plates to a relatively low value.

27. The method of claim 18, further including the step of placing a getter between the first and second plates before the step of placing the second plate on the interface surface of the frit.

28. The method of claim 18 wherein the set of second spacers is uniformly distributed throughout the cavity.

29. The method of claim 18 wherein the step of heating the first plate to a temperature in the range of 250–350 degrees centigrade comprises heating the first plate to a temperature in the range of 250–350 degrees centigrade at a pressure of between $10^{-5}$ torr and $10^{-7}$ torr.

30. The method of claim 18 wherein the step of heating the plates to a temperature in the range of 350–500 degrees centigrade comprises heating the plates to a temperature in the range of 350–500 degrees centigrade at a pressure of between $10^{-7}$ torr and $10^{-5}$ torr.

31. The method of claim 1 wherein disposing a frit bead around the perimeter of an inner surface of the first plate comprises allowing the first plate to stabilize at a temperature between 0–125 degrees centigrade for a period of approximately 1–2 hours before applying the bead of frit, and further wherein heating the frit to form a plurality of surface irregularities on an interface surface of the frit comprises gradually heating the first plate with the bead of frit to a temperature of 125–250 degrees centigrade for a period of approximately 1 hour, maintaining the first plate at a temperature in the range of 125–250 degrees centigrade for a period of approximately 1–2 hours, and gradually heating the first plate to a temperature of 250–350 degrees centigrade for a period of approximately 1 hour.

32. The method of claim 18 wherein forming an inner area on the first plate by applying a bead of frit comprises allowing the first plate to stabilize at a temperature between 0–125 degrees centigrade for a period of approximately 1–2 hours before applying the bead of frit.

33. The method of claim 18 wherein forming an inner area on the first plate by applying a bead of frit comprises allowing the first plate to stabilize at a temperature between 0–125 degrees centigrade for a period of approximately 1–2 hours before applying a bead of frit, gradually heating the first plate with the bead of frit to a temperature of 125–250 degrees centigrade for a period of approximately 1 hour, and then maintaining the first plate with the bead of frit to a temperature in the range of 125–250 degrees centigrade for a period of approximately 1–2 hours.

34. A method for evacuating and sealing a flat panel display of a type having first and second planar plates in which an image is adapted to be viewed through one of the plates, the method comprising:

allowing the first and second plates to stabilize at a temperature between 0–125 degrees centigrade for a period of approximately 1–2 hours and forming an inner area on the first plate by applying a bead of frit of generally uniform thickness along a periphery of the first plate so that an interface surface facing away from the first plate is generally flat;

gradually heating the first and second plates with the bead of frit to a temperature of 125–250 degrees centigrade for a period of approximately 1 hour;

maintaining the first and second plates at temperature in the range of 125–250 degrees centigrade for a period of approximately 1–2 hours;

gradually heating the first and second plates to a temperature of 250–350 degrees centigrade for a period of approximately 1 hour;

placing the second plate in surface to surface contact with the frit bead on the first plate;

maintaining the first and second plates at a temperature in the range of 250–350 degrees centigrade for a period of approximately 1–2 hours and evacuating the inner area through surface irregularities provided on the interface surface of the frit bead;

gradually heating the first and second plates to a temperature of 350–500 degrees centigrade for a period of approximately 1 hour;

maintaining the first and second plates at a temperature in the range of 350–500 degrees centigrade for a period of approximately 1 hour to induce the frit bead to at least partially flow;

allowing the first and second plates to cool over a period of approximately 1 hour to an intermediate temperature of about 350–425 degrees centigrade;

maintaining the first and second plates at a temperature of about 350–425 degrees centigrade for a period of approximately 1 hour; and allowing the first and second plates to cool to ambient temperature over a period of approximately 2–3 hours.

35. The method of claim 34 wherein the frit comprises glass particles mixed with a binder.

36. The method of claim 34 wherein maintaining the first and second plates at a temperature in the range of 350–500 degrees centigrade for a period of approximately 1 hour further comprises applying a force between the first and second plates toward each other by placing a weight on at least one of the plates.

37. The method of claim 36 wherein placing a weight on at least one of the plates comprises placing a weight on the plate having a magnitude causing the frit to compress to a predetermined level.

38. The method of claim 36 wherein applying a force between the first and second plates toward each other comprises applying a compressive clamping force to the first and second plates in a direction normal to the surface of the plates.

39. The method of claim 38 wherein applying a compressive clamping force to the first and second plates comprises applying a compressive clamping force to the first and second plates having a magnitude causing the frit to compress to a predetermined level.

40. The method of claim 34 wherein the flat panel display is a field emission display, wherein the first planar plate comprises a field emission display faceplate and wherein the second planar plate comprises a field emission display baseplate.

41. The method of claim 34 wherein maintaining the first and second plates at a temperature in the range of 250–350 degrees centigrade for a period of approximately 1–2 hours and evacuating the inner area comprises reducing the pressure in the environment surrounding the plates to $10^{-7}$ torr.

42. The method of claim 34 wherein maintaining the first and second plates at a temperature in the range of 250–350 degrees centigrade for a period of approximately 1–2 hours and evacuating the inner area comprises reducing the pressure in the environment surrounding the plates over a period of approximately 2 hours, thereby limiting the differential pressure across the plates to a relatively low value.

43. The method of claim 34 wherein allowing the first and second plates to stabilize at a temperature between 0–125 degrees centigrade for a period of approximately 1–2 hours further comprises placing a getter between the first and second plates before placing the second plate on the interface surface of the frit.

44. The method of claim 34 wherein maintaining the first and second plates at a temperature in the range of 250–350 degrees centigrade for a period of approximately 1–2 hours and evacuating the inner area comprises maintaining the first and second plates at a temperature in the range of 250–350 degrees centigrade for a period of approximately 1–2 hours at a pressure of between $10^{-5}$ torr and $10^{-7}$ torr.

45. The method of claim 34 wherein maintaining the first and second plates at a temperature in the range of 350–500 degrees centigrade for a period of approximately 1 hour to induce the frit bead to at least partially flow comprises maintaining the first and second plates at a temperature in the range of 350–500 degrees centigrade for a period of approximately 1 hour at a pressure of between $10^{-7}$ torr and $10^{-5}$ torr.

* * * * *